United States Patent [19]

Illemann et al.

[11] Patent Number: 4,657,226

[45] Date of Patent: Apr. 14, 1987

[54] APPARATUS FOR INTRODUCING GAS TO MOLTEN METAL WITHIN A VESSEL

[75] Inventors: Heinrich Illemann, St. Magdalen; Gustav M. Heinricher, Döbriach, both of Austria

[73] Assignee: Osterreichisch-Amerikanische Magnesit Aktiengessellschaft, Austria

[21] Appl. No.: 776,441

[22] Filed: Sep. 16, 1985

[30] Foreign Application Priority Data

Sep. 18, 1984 [AT] Austria ..... 296284

[51] Int. Cl.[4] ..... C21C 5/48

[52] U.S. Cl. ..... 266/220; 266/270

[58] Field of Search ..... 266/220, 265, 266, 270; 75/59.26, 59.3

[56] References Cited

U.S. PATENT DOCUMENTS

| | | | |
|---|---|---|---|
| 3,490,755 | 1/1970 | Lutgen | 266/220 |
| 3,610,602 | 10/1971 | Deacon | 266/220 |
| 4,340,208 | 7/1982 | Vayssiere et al. | 266/220 |
| 4,396,179 | 8/1983 | Labate | 266/220 |

FOREIGN PATENT DOCUMENTS

| | | | |
|---|---|---|---|
| 0105868 | 4/1984 | European Pat. Off. | 266/220 |
| 1458806 | 11/1969 | Fed. Rep. of Germany . | |
| DE31102-04A1 | 10/1982 | Fed. Rep. of Germany . | |
| 3341446 | 7/1985 | Fed. Rep. of Germany | 266/270 |
| 2451945 | 10/1980 | France | 266/265 |
| 2096290A | 10/1982 | United Kingdom | 266/265 |

OTHER PUBLICATIONS

Russian Abstract SU 1036-754-A, Metallurgy, p. 26, Week 8420.

*Primary Examiner*—L. Dewayne Rutledge
*Assistant Examiner*—Robert L. McDowell
*Attorney, Agent, or Firm*—Finnegan, Henderson, Farabow, Garrett & Dunner

[57] ABSTRACT

The invention relates to apparatus including a gas purge brick for metallurgical furnaces and vessels, which is connected with a gas supply pipe on its cold end remote from the interior of the furnace or vessel. Within the gas supply pipe there is centrally arranged a solid metal core which is surrounded by a helix. Optionally, at least the part of the gas supply pipe adjoining the cold brick end is surrounded by a protecting tube filled with a refractory material.

12 Claims, 1 Drawing Figure

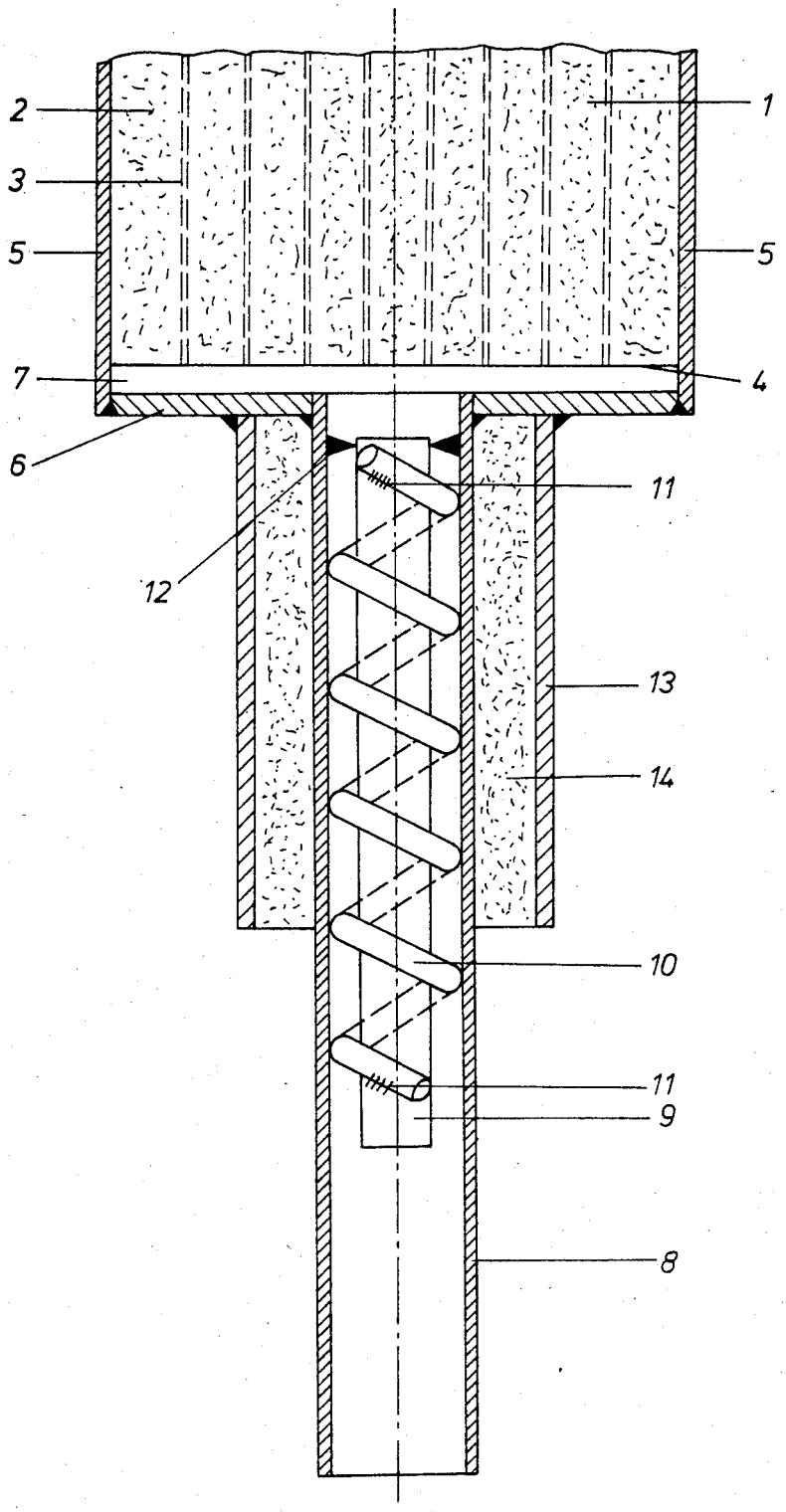
2
3
5
7
6
12
1
5
4
11
13
14
10
11
9
8

APPARATUS FOR INTRODUCING GAS TO MOLTEN METAL WITHIN A VESSEL

BACKGROUND OF THE INVENTION

In recent times, gas-permeable refractory bodies generally described as purge bricks or purge plugs have increasingly been used to introduce various gases into metallurgical furnaces and vessels through their lining for the treatment of molten metals. Such purge bricks are provided particularly in converters for refining hot metal, in hot metal ladles, in foundry ladles and in tundishes used in the continuous casting of steel. Generally, the purge bricks are provided in the bottom of these vessels; however, they may also be incorporated into the lining of the side walls of all such units as well as of other metallurgical furnaces and vessels, such as electric arc furnaces or vessels for treating non-ferrous metals, e.g., aluminum melting furnaces.

Purge bricks may have an increased normal porosity, i.e., bricks having a high number of randomly distributed pores, or a so-called directed porosity or directed pores, i.e., bricks through which a number of pores extend continuously in a desired direction. An advantage of bricks having a directed porosity is that fine-grained solids entrained in gases can be blown through the directed pores, if desired.

Purge bricks of the kind usually employed have often the disadvantage that their durability is lower than that of the refractory lining provided in the furnace or vessel adjacent to the purge bricks. This results in the premature wear of the purge bricks which necessitates a shutdown of the furnace or vessel for repair. For this reason various attempts have been made to improve the durability of purge bricks. Purge bricks in most cases are arranged in an opening or within a perforated brick in the vessel lining. Known apparatus including purge bricks includes a purge brick covered with sheet metal on its side walls and bottom surface. Gas is introduced to the pores in the brick and thereby into the vessel interior through a spiral pipe embedded in the refractory (French Application 24 51 945). The spiral pipe is intended to effect a solidification of molten metal which has entered the purge brick because of wear or cracking and/or which has entered the purge brick or between the purge brick and the opening in which the purge brick is placed because the sheet metal covering of the purge brick has been damaged. In this manner, flow of molten metal out of the vessel is prevented.

A major disadvantage of this purge brick assembly is that it is not easily replaced and consequently relatively long interruptions of the operation of the furnace or vessel will be necessary. Another known purge brick assembly is disposed in an opening in a refractory lining and is provided with a gas supply pipe that is not directly connected to the purge brick of the assembly but connected to an optionally spiral-shaped pipe coil. The coil is connected to the purge brick and embedded either in the purge brick itself or in a refractory body consisting of a refractory block disposed under the purge brick (German Application 31 10 204). A breakthrough of metal cannot reliably be prevented with this design. A substantial improvement is achieved by the use of purge bricks which at the end remote from the interior of the furnace or vessel rest on a safety block. The supply of gas is provided by a system including a partly vertically extending, double pipe coil that is embedded in the safety block (European Patent Application 105,868). The increased surface area resulting from the double pipe coil increases the solidification rate of molten metal entering the system from the vessel.

SUMMARY OF THE INVENTION

It is accordingly an object of the present invention to provide an apparatus embodying a purge brick that effectively introduces gas to molten metal within a vessel and yet prevents ingress of metal from the vessel into the gas supply system.

A related object of the invention is to provide an apparatus of this type characterized by ease of assembly and construction.

The apparatus of the invention for introducing gas to molten metal within a vessel interior embodies a refractory purge brick that has a first surface adjacent the vessel interior. A second surface of the brick is connected to a gas supply. A plurality of openings are provided within the brick and these openings communicate with the vessel interior and the gas supply. The gas supply includes a gas conduit through which gas flows to the brick, through the openings in the brick and into the vessel interior. Cooling means are provided within the gas conduit for cooling and solidifying any molten metal entering the conduit from the vessel interior. The cooling means may embody a core within the conduit and means cooperating with gas flowing through the conduit for causing molten metal entering the conduit from the vessel interior to contact the core for cooling and solidification. The means cooperating with the gas flowing through the conduit may cooperate with the gas to cause molten metal entering the conduit to contact the core for cooling and solidification. A helical member surrounding a longitudinal portion of the core may be provided for this purpose. The core may be a rod positioned axially within the conduit and within a helical member surrounding a longitudinal portion of the rod. A gas distribution chamber may be provided between the surface of the brick connected to the gas supply and the gas conduit. At least a portion of the conduit may be provided with exterior insulation for preventing molten metal break-out from the conduit. The exterior insulation may include a tube filled with refractory material surrounding the gas conduit. The first surface of the brick adjacent the vessel interior and the second surface connected to the gas supply are generally opposed.

BRIEF DESCRIPTION OF THE DRAWING

The single FIGURE of the drawing is a longitudinal sectional view of one embodiment of apparatus in accordance with the practice of the invention.

DESCRIPTION OF THE PREFERRED EMBODIMENT

In accordance with the invention there is provided an apparatus for introducing gas to molten metal within a vessel interior which apparatus includes a refractory purge brick having a first surface adjacent the vessel interior and a second surface communicating with gas supply means. In the preferred embodiment the purge brick as shown in the drawing and designated as 1 may have any desired shape, such as the illustrated parallelepipedic shape or conical shape and may be arranged in an opening, e.g. in a perforated brick, in the vessel refractory lining (not shown). The selection of the refractory material of which the purge brick is made is also not significant for the present invention, and the refractory material may be selected in accordance with the purpose for which the brick is to be used. The brick has a plurality of openings within the brick communicating with the vessel interior and gas supply means. In accordance with the preferred embodiment these openings may be normal pores 2, which are undirected and randomly distributed, and preferably also may comprise directed pores 3, which extend along the brick and are continuous from a cold end 4 of the brick to a hot end (not shown), which faces the interior of the furnace or vessel. Further, in accordance with the preferred embodiment of the invention, the purge brick 1 is covered on its side faces by a surrounding sheet metal mantle 5. At its cold end 4, which is remote from the interior of the furnace or vessel, the brick is provided with a sheet metal bottom 6. The sheet metal mantle 5 may extend throughout the whole side length of the purge brick or may cover the side face of the brick only near its cold end portion. The sheet metal mantle 5 and the sheet metal bottom 6 have the effect that all of the supplied purge gas will enter the brick and cannot escape to the outside. A gaplike space 7 may be provided between the cold end 4 of the brick and the sheet metal bottom 6. This space 7, which may be described as a gas supply gap or gas distribution chamber, serves to ensure uniform distribution of the supply gas stream over the cross-section of the brick.

The cold end 4 of the brick near sheet metal bottom 6 is connected to a gas supply pipe 8 for supplying the desired purge gas or purge fluid to the purge brick 1. Cooling means in accordance with the invention are provided for cooling and solidifying molten metal entering the gas supply pipe or conduit from the vessel interior. In the preferred embodiment of the invention for this purpose the gas supply pipe 8 contains a centrally disposed solid core 9, which extends along the pipe 8. It consists preferably of a steel core, which is preferably in the form of a rod. A metal helix 10 surrounds the core 9 helically and preferably is also made of steel. This helix 10 is preferably made of steel wire and is wound around the metal core and is secured to the metal core in any suitable manner, such as by welding designated as 11 in the drawing. Alternately, the helix may merely resiliently embrace the metal core 9. Through the space between the metal core 9 and the inside surface of the gas supply pipe 8 the purge gas or other fluid flows to the purge brick 1. The metal core 9 is secured to the gas supply pipe 8 as by welding, designated as 12 in the drawing. Alternately, screws or pins (not shown) extending from the outside through the the wall of the gas supply pipe 8 and into the iterior thereof may be used.

The metal core 9 constitutes together with the helix 10 effective means for preventing a molten metal breakthrough. The metal core 9 and helix 10 in contact with the inside surface of the gas supply pipe 8 will force any liquid metal which is broken through the purge brick 1 and into the pipe 8 to flow in a plurality of convolutions around the metal core, so that the liquid metal will be cooled and rapidly solidified.

In accordance with the invention at least a portion of the conduit or gas supply pipe 8 is provided with exterior insulation for preventing molten metal breakout from the conduit. Further in accordance with the invention this exterior insulation includes a tube filled with refractory material surrounding the conduit. In the preferred embodiment of the invention the gas supply pipe 8 is optionally surrounded by a concentric projecting tube 13, preferably at a proportion of the gas supply pipe or conduit adjoining the cold end 4 of the brick. The protecting tube 13 is filled with refractory material 14, which may be a cast refractory. This projecting tube 13 provided with the refractory material 14 ensures that any liquid metal which has entered the gas supply pipe 8 will not break out through the wall of the pipe.

What is claimed is:

1. An apparatus for introducing gas to molten metal within a vessel interior, said apparatus comprising a refractory purge brick having a first surface adjacent said vessel interior, a second surface communicating with gas supply means, a plurality of openings within said brick communicating with said vessel interior and said gas supply means, said gas supply means including a gas conduit through which gas flows to said brick, through said openings in said brick and into said vessel interior; and cooling means within said gas conduit for cooling and solidifying molten metal entering said conduit from said vessel interior.

2. The apparatus of claim 1 wherein said cooling means includes a core within said conduit and means cooperating with gas flowing through said conduit for causing molten metal entering said conduit to contact said core to induce solidification of said metal.

3. The apparatus of claim 1 wherein said cooling means includes a core within said conduit and a helical member surrounding a longitudinal portion of said core, said helical member cooperating with said gas flowing through said conduit to cause molten metal entering said conduit to contact helically said core and solidify.

4. The apparatus of claim 1 wherein said cooling means includes a core rod positioned axially within said conduit and within a helical member surrounding a longitudinal portion of said rod, said helical member cooperating with said gas flowing through said conduit to cause molten metal entering said conduit to contact helically said core rod and solidify.

5. The apparatus of claim 4 wherein at least a portion of said conduit is provided with exterior insulation for preventing molten metal break-out from said conduit.

6. The apparatus of claim 5 wherein said exterior insulation includes a tube filled with refractory material surrounding said conduit.

7. The apparatus of claim 1 wherein a gas distribution chamber is provided between said second surface of said brick and said gas conduit.

8. The apparatus of claim 1 wherein said first and second surfaces of said brick are generally opposed.

9. An apparatus for introducing gas to molten metal within a vessel interior, said apparatus comprising: a refractory purge brick having a plurality of openings within said brick communicating with said vessel interior, said brick having a first surface adjacent said vessel interior and a second surface generally opposed to said first surface, said openings in said brick communicating with a gas conduit through which gas flows to said brick, through said openings in said brick and into said vessel interior; a core positioned axially within said conduit, said core having a helical member surrounding a longitudinal portion of said core, said helical member cooperating with said gas flowing through said conduit to cause molten metal entering said conduit to contact helically said core and solidify; and a gas distribution chamber provided between said second surface of said brick and said gas conduit.

10. The apparatus of claim 9 including a tube filled with refractory, said tube surrounding at least a portion of said conduit.

11. An apparatus for introducing gas to molten metal within a vessel interior, said apparatus comprising a refractory purge brick having a first surface adjacent said vessel interior, a second surface opposite said first surface and communicating with gas supply means, a plurality of openings within said brick communicating with said vessel interior and said gas supply means, said gas supply means including a gas conduit through which gas flows to said brick, through said openings in said brick and into said vessel interior; and cooling means within said gas conduit for cooling and solidifying molten metal entering said conduit from said vessel interior, said cooling means including a core positioned within said conduit and a helical member surrounding a longitudinal portion of said core, said helical member cooperating with said gas flowing through said conduit to cause molten metal entering said conduit to contact helically said core and solidify.

12. The apparatus of claim 11 wherein said cooling means includes a core rod positioned axially within said conduit and within a helical member surrounding a longitudinal portion of said rod.

* * * * *